US005211090A

United States Patent [19]

Rathert

[11] Patent Number: 5,211,090

[45] Date of Patent: May 18, 1993

[54] METHOD OF AND APPARATUS FOR SHAPING THE CORNERS OF STACKED SHEET MATERIAL

[75] Inventor: Horst Rathert, Minden, Fed. Rep. of Germany

[73] Assignee: Kolbus GmbH & Co. KG, Rahden, Fed. Rep. of Germany

[21] Appl. No.: 686,423

[22] Filed: Apr. 16, 1991

[30] Foreign Application Priority Data

Apr. 21, 1990 [DE] Fed. Rep. of Germany ..... 4012721
Feb. 2, 1991 [DE] Fed. Rep. of Germany ..... 4104428

[51] Int. Cl.[5] ..... B26D 7/06

[52] U.S. Cl. ..... 83/24; 83/91; 83/282; 83/158; 83/422; 83/100; 83/452; 83/471.2; 83/934

[58] Field of Search ..... 83/91, 282, 158, 112, 83/422, 431, 100, 452, 471.2, 475, 934, 280, 281, 23

[56] References Cited

U.S. PATENT DOCUMENTS

| | | | |
|---|---|---|---|
| 445,923 | 2/1981 | Carrer | 83/452 |
| 3,559,516 | 2/1971 | Freeman | 83/158 |
| 3,733,947 | 5/1973 | Bryson et al. | 83/280 |
| 4,648,772 | 3/1987 | Hartlage | 83/281 |
| 4,941,376 | 7/1990 | Otsuka | 83/100 |

*Primary Examiner*—Frank T. Yost
*Assistant Examiner*—Allan M. Schrock
*Attorney, Agent, or Firm*—Chilton, Alix & Van Kirk

[57] ABSTRACT

The corners of stacked sheet material, for example overlay material being employed in the formation of book covers, are simultaneously removed by a cutting appliance having plural knives. Stacks of the sheets of overlay material are delivered to the cutting appliance by carriers which move along a continuous path and, after the cutting operation, the carriers deliver the sheet material to the feed station of a downstream processing machine.

21 Claims, 5 Drawing Sheets

METHOD OF AND APPARATUS FOR SHAPING THE CORNERS OF STACKED SHEET MATERIAL

BACKGROUND OF THE INVENTION

1. Field of the Invention

The present invention relates to the shaping of sheet material and particularly to severing the corners from sheets of material which have previously been stacked as part of a book manufacturing process. More specifically, the present invention is directed to apparatus for removing the corners of stacked sheets prior to further processing of such sheets in, for example, the course of production of book covers. Accordingly, the general objects of the present invention are to provide novel and improved methods and apparatus of such character.

2. Description of the Prior Art

Thin sheets of overlay material are often required in the production of book covers. These overlay sheets must be shaped, specifically the corners must be cut therefrom, prior to use. In the prior art, the sheets of overlay material have been stacked, each stack containing a relatively small number of sheets, and the stacks then manually positioned in a corner-cutting machine. The previously available corner-cutting machines are bench-type appliances which include a supporting surface, with an angled stop, and a manually operable cutting tool. In these known appliances, the four corners of the stacked rectangular overlay sheets are removed, in sequence, through operation of the cutting tool by means of a hand lever.

A corner-cutting appliance of the type generally described above is, for example, disclosed in published German Patent Application Serial No. 36 13 511. This published application describes an appliance having a cutting tool which is in the form of a dish-shaped knife with a cutting edge on the outside of the dish rim. This arrangement, at least in theory, provides a clean and uniform cut.

The withdrawal of partial stacks of overlay sheet material from a larger stack, the placing of such partial stacks on the supporting surface of a corner-cutting appliance, the alignment of the stack in the appliance and the subsequent cutting operation is an extremely time-consuming, labor-intensive operation. This operation occupies a substantial portion of the time available to a machine operator who may have other tasks to perform. Also, because the corner-cutting operation has previously been performed manually and misalignment of the stack of sheets which are to have their corners removed is thus an inherent possibility, great care has been required in the interest of minimizing cutting inaccuracies with the resultant waste of material.

SUMMARY OF THE INVENTION

The present invention overcomes the above briefly discussed and other deficiencies and disadvantages of the prior art by automating the removal of the corners of stacked sheet material destined for further processing, particularly in a book cover forming machine. The practice of the present invention improves both the quality of the cut and cutting accuracy. The present invention also increases the efficiency of production of book covers or the like.

Apparatus in accordance with a preferred embodiment of the invention includes a novel corner-cutting appliance which is installed so that the stacks of sheet material which are shaped therein may be immediately delivered to the sheet feed station of a book cover production machine or the like. The corner-cutting appliance of the present invention is provided with four knives, each knife being brought into operational contact with a different corner of a stack of rectangular sheets. The cutting appliance is further provided with a hold-down device for the stack of sheets being cut. The apparatus of the invention also includes a stack carrier which transports, along a defined path, the stack of sheets from a loading position to a cutting position and thence to the book cover production machine sheet feed station. In accordance with a preferred embodiment, the stack carrier is mounted on a closed-circuit rail system and includes a movable support which displaces the stacked sheet material in a direction generally transverse to the rail system defined path, i.e., the stack lifter support produces relative motion between the stacked sheets and stationary knives, during the corner-cutting procedure.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 3:
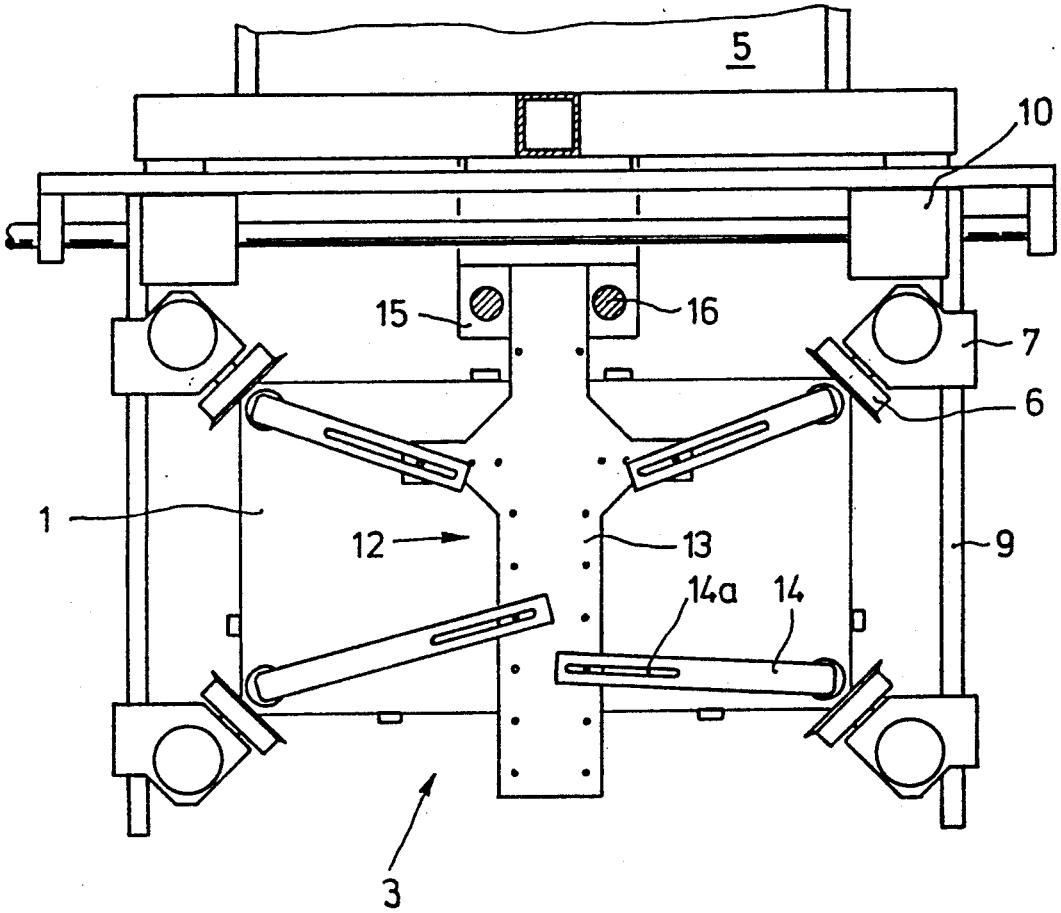
FIG. 3 is a top plan view of the apparatus of FIGS. 1 and 2.
Figure 4:
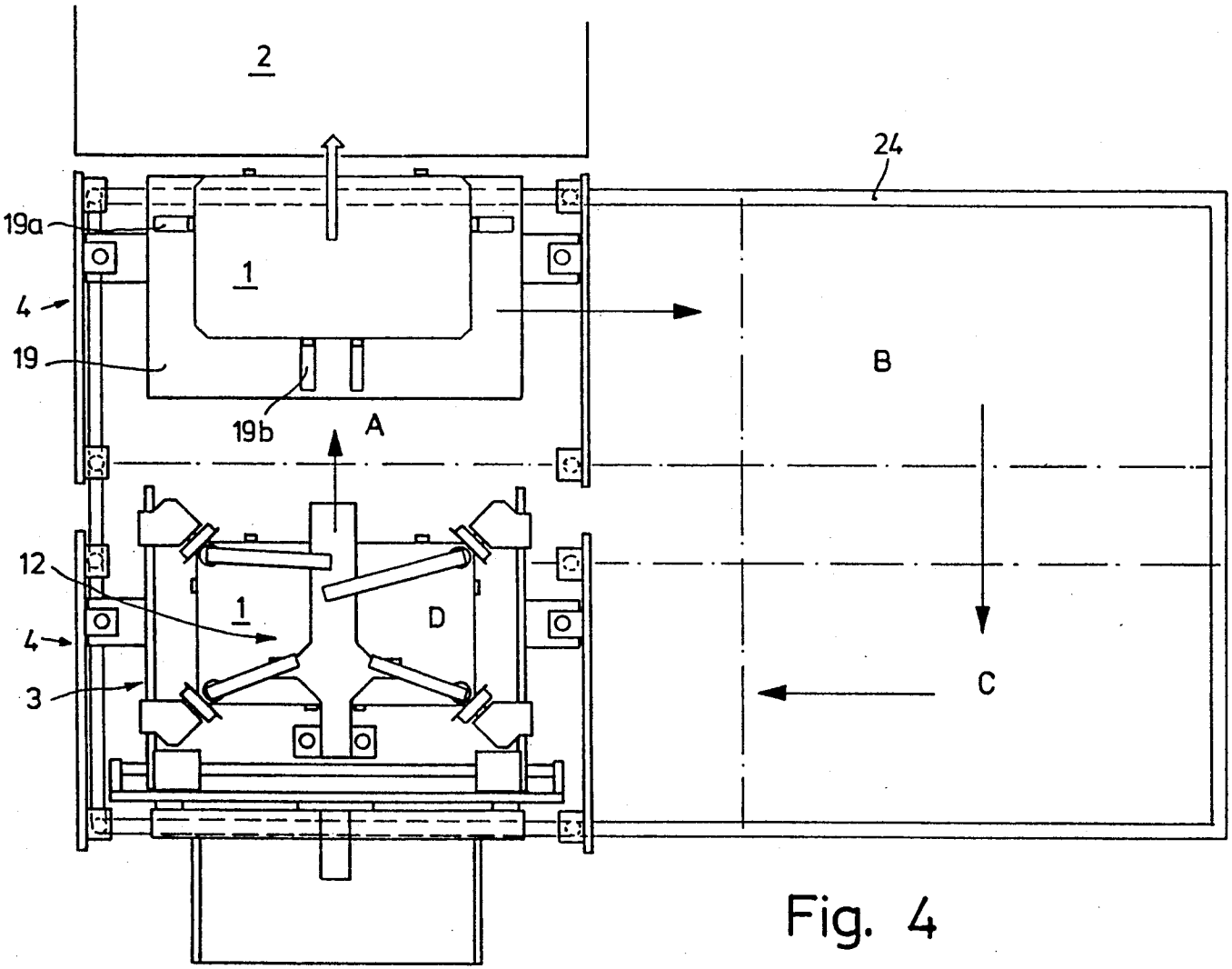
FIG. 4 is a view, taken in the direction of FIG. 3, which schematically represents automated corner-cutting apparatus, including the cutting appliance of FIGS. 1–3, in accordance with the preferred embodiment of the invention.

Apparatus for processing stacks of overlay sheet material, such stacks being indicated at 1, is depicted in FIG. 4. This apparatus comprises a cutting appliance, indicated generally at 3 in FIGS. 1, 3 and 4, which removes the corners from the stacked sheets. The apparatus further comprises carriers in the form of stack lifters which are indicated generally at 4 in FIGS. 1 and 4. The apparatus functions, in the manner to be described below, to shape the sheets of overlay material and thereafter deliver the shaped sheets to the feed station of a book cover production machine which has been indicated schematically at 2 in FIG. 4.

Figure 1:
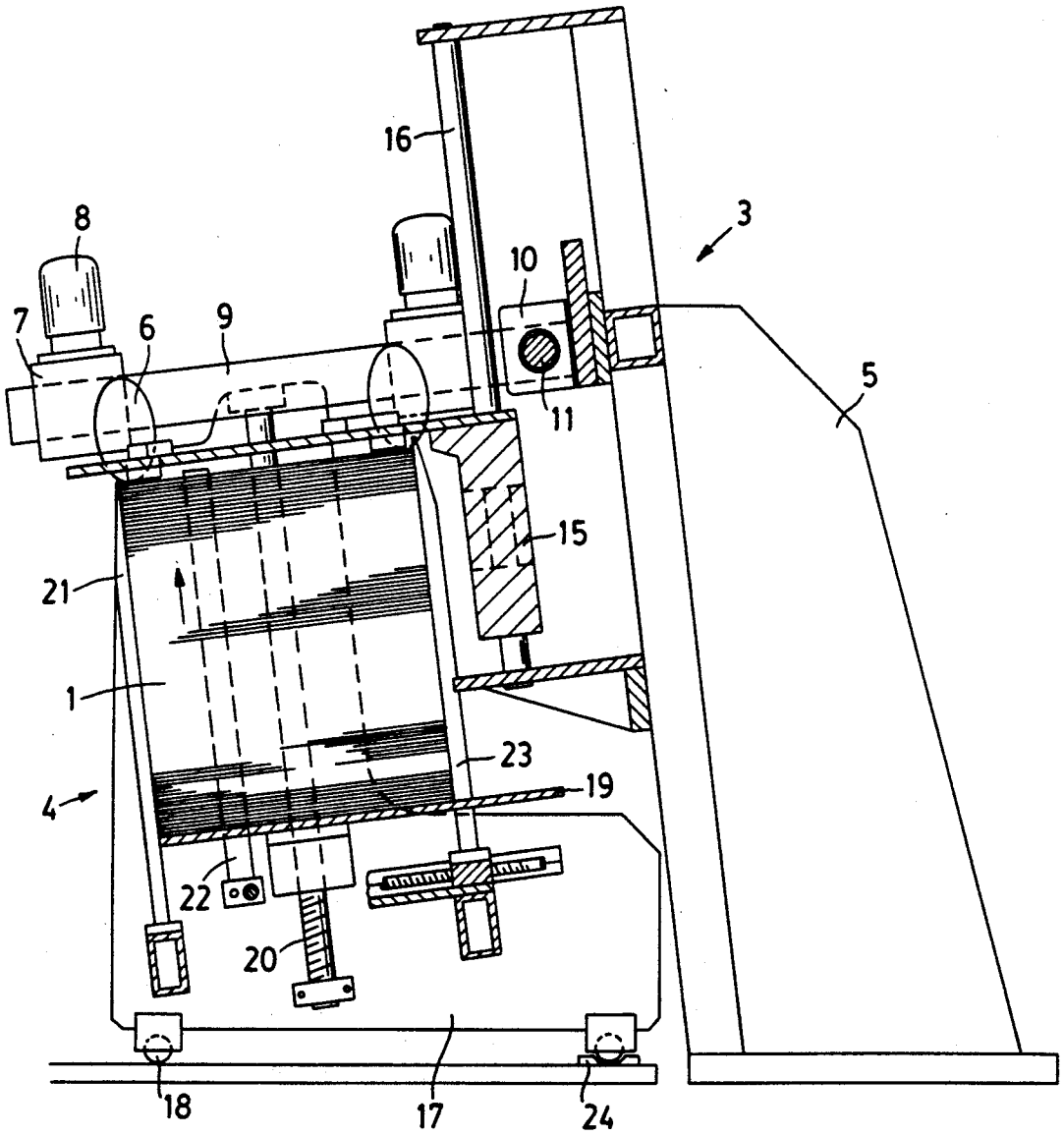
FIG. 1 is a side elevation view, partially in section, of a corner-cutting appliance and stack carrier in accordance with a first embodiment of the invention.
Figure 2:
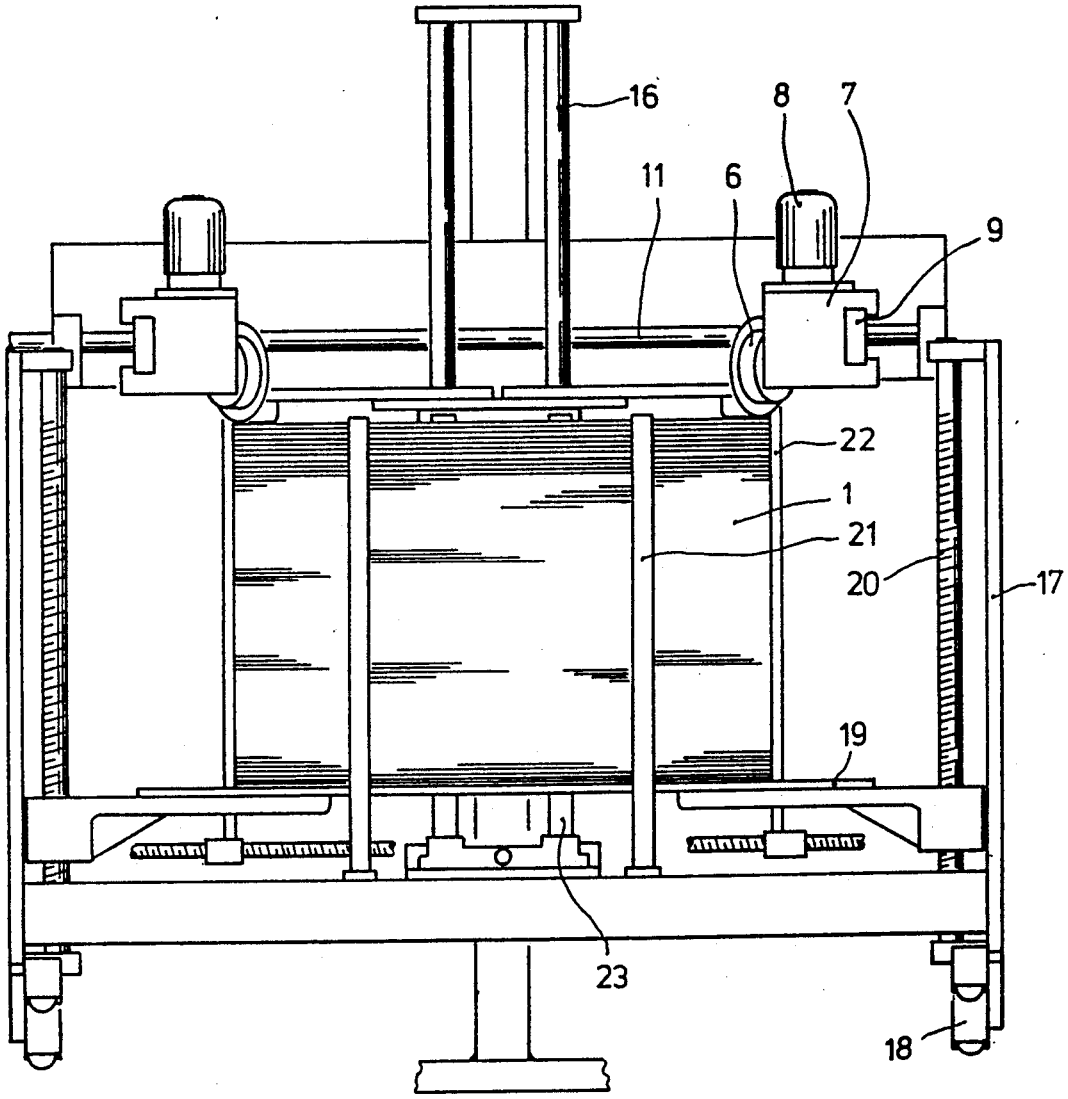
FIG. 2 is a front view of the apparatus of FIG. 1.

Referring jointly to FIGS. 1 and 2, the corner-cutting appliance 3 comprises an inclined support frame 5 from which, in the manner to be described below, circular knives 6 are supported. The knives 6 are capable of simultaneous operation so that all four of the overlay sheets comprising a stack 1 may be simultaneously severed.

The knives 6 are mounted from bearing blocks 7 and, in the disclosed embodiment, are provided with individual drives 8. In order to accommodate different size overlay sheets, the positions of the bearing blocks 7 can be adjusted in the transverse and longitudinal directions. This position adjustment is permitted by slidably mounting the bearing blocks 7 on rails 9 which, in turn, are slidably supported on a transverse shaft 11 by means of guide members 10. The shaft 11 is mounted on the support frame 5 as may best be seen from FIGS. 2 and 3. Means known in the art, which have been omitted from the drawings in the interest in facilitating understanding of the invention, are employed for locking the bearing blocks 7 at the desired positions on the rails 9 and for similarly locking the guides 10 at the desired positions on shaft 11.

The knives 6 are caused to rotate in directions which are chosen to ensure that the severed corners are ejected outwardly at the cutting edge of each knife. The severed corners are collected by suction nozzles, not shown, located below the knives and are conveyed to a central waste extraction apparatus. It will be understood by those skilled in the art that, rather than employing separate drives 8, rotation can be imparted to the knives 6 from a common power source.

The corner-cutting appliance 3 of the present invention is provided with a hold-down device, indicated generally at 12 in FIGS. 2 and 3, which maintains the stack of sheet material in position during the cutting operation. In the disclosed embodiment, the hold-down device 12 operates under the influence of gravity, i.e., the sheets are retained in position solely by the weight of the hold-down device. Hold-down device 12 comprises a carrier frame 13 on which hold-down elements 14 are adjustably retained. A separate hold-down element 14 is associated with each of the knives 6 in the interest of immobilizing the stacked sheets 1 in the regions thereof adjacent the cutting lines. As will be obvious to those skilled in the art, a hold-down plate matched to the size of the overlay sheets being processed can be substituted for the individual hold-down elements 14.

The hold-down device 12 is, like the rotating knives 6, mounted from the inclined support frame 5. The mounting for the hold-down device 12 comprises a guide 15 which is engaged by the carrier frame 13. Guide 15 is slidably mounted on a pair of parallel guide rods 16 which, as may be seen from FIG. 1, are mechanically connected to the support frame 5. Accordingly, the carrier frame 13, and thus the hold-down elements 14, may freely move up and down to accommodate different stack heights and to travel with the stack as it is raised and lowered as shall be described below. The hold-down elements 14 are provided with slots 14*a* which enable the elements 14 to be individually positioned relative to carrier frame 13, in the transverse and longitudinal directions, so as to match the size of the overlay sheet being processed.

In accordance with the present invention, the stack lifters 4 are designed as mobile units which can be moved from a loading position into the operating area of the corner-cutting appliance 3. Thus, each stack lifter 4 consists of a travelling chassis 17, provided with running rollers 18, and a stack support plate 19. The stack support plate 19, as may be seen from FIG. 1, is inclined at the same angle as the corner-cutting appliance. The support plate 19 is movable, in the vertical direction, through the agency of positioning spindles 20 which are mounted from chassis 17. The spindles 20 are rotated, to raise and lower plate 19, by drive means which have not been shown.

A stack 1 of sheets of overlay material which has been placed on a support plate 19 of a stack lifter 4 will be confined on all sides by guides. Referring to FIGS. 1 and 2, the front guides are indicated at 21 and are fastened to the chassis 17 at fixed locations. The or side lateral guides 22 and the rear guide 23 are adjustably coupled to chassis 17 so that they may be positioned to accommodate the size of the overlay sheet being processed. The adjustments of the lateral guides 22 and rear guide 23 is permitted by providing slots 19*a* and 19*b* in the support plate 19, as shown in FIG. 4, and by providing means, not shown, for locking the guides to the support plate when they have been placed in their proper positions along the slots.

As may be seen from FIG. 4, which comprises a layout plan of apparatus in accordance with a preferred embodiment of the invention, four stations, indicated by A to D, are assigned to a closed-circuit rail system 24. The stack lifters 4 are caused to move, in the directions indicated by arrows, along this closed circuit. Station A is the feed position where sheets of overlay material forming a stack 1 are serially withdrawn from the stack and fed to the book cover production machine 2. Station B is an intermediate position which enables stack lifters 4 to be interchanged. Station C is the stack lifter loading position where a fresh stack of sheets of overlay material is placed on the support plate 19 which, at this time, has been lowered to the degree necessary. The corner-cutting appliance 3 is installed at station D and, as noted, all four corners of a stack of sheets 1 are simultaneously removed by means of the knives 6 at station D. It will be understood that the operation of the knives 6 on all of the sheets comprising a stack 1 results from the fact that the support plate 19 is driven upwardly, through the agency of the rotatable spindles 20, so that the knives 6 act on the sheets as they are raised by plate 19 while simultaneously being held down by the hold-down elements 14. Once the cutting operation is completed, the support plate 19 is returned to its starting position and the stack lifter 4 is translated to feed station A.

A particularly novel and important feature of the present invention comprises the use of at least two mobile stack lifters 4. The use of two stack lifters permits a cutting operation to be performed on a second stack of sheets of overlay material while the sheets of a previously trimmed stack are being fed to the book cover production machine 2.

In accordance with a modified form of the invention, the support plate 19 may be of two piece design and both pieces can be caused to move up and down independently. The employment of a two-piece support plate necessitates the provision of appropriate arrangements for guiding the up and down movements of the two plates. A two-piece support plate is employed for a double operation in which the boards which define the book covers receive their overlay material and are fitted.

Figure 5:
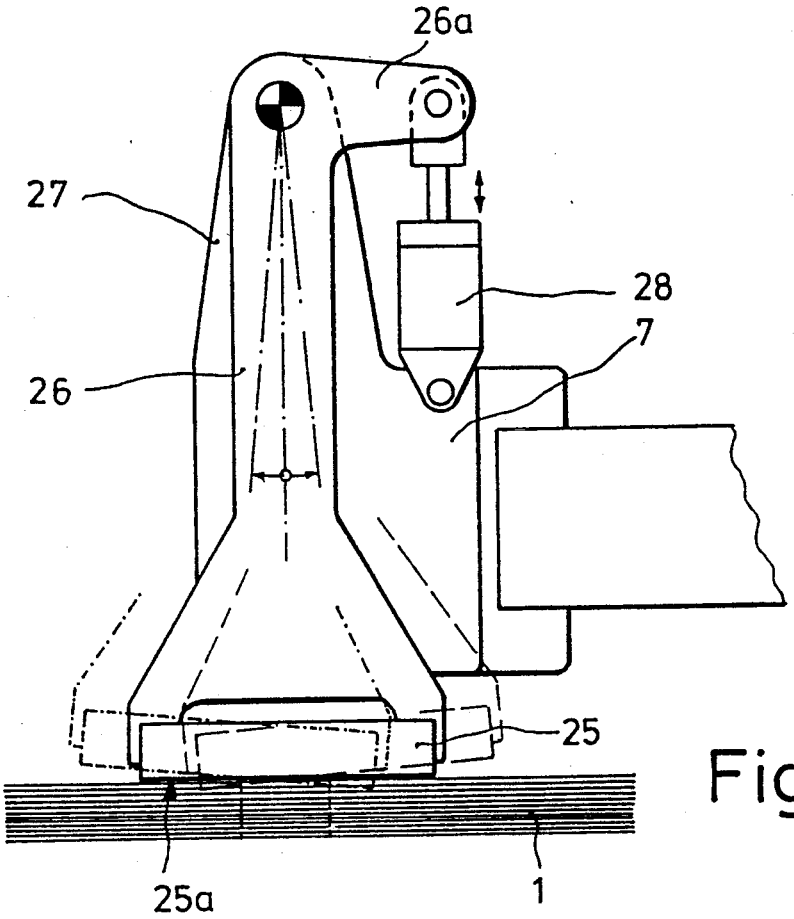
FIG. 5 is a partial view of a modified form of a portion of a corner-cutting device in accordance with the invention, FIG. 3 depicting a knife of a different design when compared to that shown in FIGS. 1 and 2.
Figure 6:
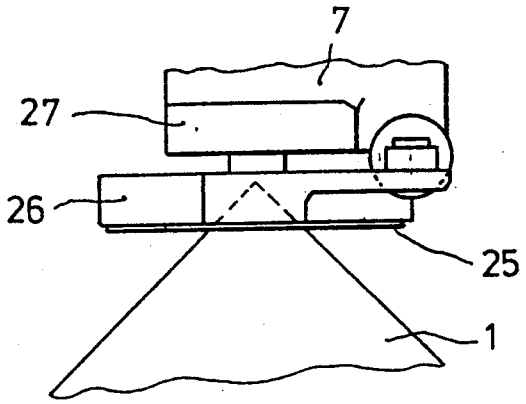
FIG. 6 is a partial plan view of the apparatus of FIG. 5.

FIGS. 5 and 6 depict another modification of the invention. To counteract the risk of fraying, which may be a problem when the overlay material being shaped is comprised of a material such as linen or the like, knives 25 which have a straight cutting edge may be employed in place of the circular knives 6. The straight cutting edges 25*a* of the knives 25 are caused to execute a reciprocating movement along curved paths while following linear cutting lines which extend across the corners of a stack of sheets 1 located in the magazine defined by the guides 21–23 of a stack lifter 4. This reciprocating or swinging movement is produced by mounting the knives 25 on carriers 26 which are rotatably supported in vertical brackets 27. The cuts formed by knives 25 start at the edges of a sheet 1 at points displaced rom each corner, i.e., at the ends of a cutting line and progress toward the mid-point of the cutting line as the stack is advanced toward the knives, the corners being completely severed from the sheets by the swinging knives 25 as this advancement continues until all of the sheets comprising the stack have been cut across the entire length of the cutting lines. The brackets 27 project from the bearing blocks 7. The reciprocating movement is generated by double-acting pneumatic cylinders 28 which are connected between the bearing block 7 and an arm 26*a* which projects transversely from the knife carrier 26. The pneumatic cylinders 28 are preferably controlled in a manner such that adjacent knives 25 execute their cutting movements in opposite directions. This mode of operation has an immobilizing effect on the material being cut.

While preferred embodiments have been shown and described, various modifications may be made thereto without departing from the spirit and scope of the invention. For example, rather than feeding the sheets being trimmed into the knives of the cutting appliance with a movable support plate(s), the knives may be caused to move toward and away from a stationary stack lifter support plate. Accordingly, it is to be understood that the present invention has been described by way of illustration and not limitation.

What is claimed is:

1. Apparatus for shaping unbound individual sheets of material which have been assembled into a stack, the shaped sheets subsequently being withdrawn form the stack at a downstream feed station for further processing, sand apparatus comprising:

corner-cutting means, said cutting means being provided with a plurality of knives which will be simultaneously brought into operational contact with the corners of a stack of sheets of material, said cutting means further including movable hold-down means which engage the top of a stack of sheets during the shaping thereof; and stack carrier means, said carrier means including guide members which define a magazine for receiving a stack of sheets to be shaped, said carrier means also having a stack support surface which defines a plane, said carrier means being movable between a stack loading position and a position under said cutting means, relative movement between said knives and a stack of sheets in a direction which is angularly oriented relative to said plane when said carrier means is positioned in said cutting means resulting in establishment of engagement between said knives and the stack and the progressive removal of corners from the sheets comprising the stack, said carrier means further being movable from the position in said cutting means to said feed station.

2. The apparatus of claim 1 wherein said feed station is associated with apparatus for the production of book covers and wherein said apparatus includes at least two of said carrier means whereby sheets of shaped material may be removed from a stack on a first carrier means at said feed station while corners are being removed from the sheets of material comprising a stack in a second carrier means positioned in said cutting means.

3. The apparatus of claim 2 further comprising:

means defining a closed-circuit path for movement of said carrier means whereby said carrier means may be moved from a loading station to a cutting station where the stack of sheets is cut by a second cutting means and then moved to said feed station, said carrier means thereafter being returned to said loading station without passing through said cutting station.

4. The apparatus as claimed in any one of claims 1 to 3 wherein the locations of said cutting means knives are fixed during a corner cutting operation and wherein said carrier means each comprise a movable support plate which defines said support surface and means for imparting motion to said plate whereby the stacked sheet material may be fed into operative engagement with said knives.

5. The apparatus as claimed in any one of claims 1 to 3 wherein said hold-down means comprises plural hold-down elements which respectively contact the uppermost sheet of a stack of sheets of material adjacent a cutting lien defined by a said knife and exert a compressive force on the stack of sheets.

6. The apparatus as claimed in any one of claims 1 to 3 further comprising adjustable support means for said knives wherein the location of said cutting means knives can be varied in a pair of transverse directions to accommodate different sheet sizes.

7. The apparatus as claimed in any one of claims 1 to 3 wherein said hold-down means comprises a replaceable plate which is commensurate in size with the size of the sheet material being shaped.

8. The apparatus as claimed in any one of claims 1 to 3 wherein the positions of at least some of said carrier means magazine defining guides can be adjusted whereby said carrier means may accommodate different size sheets of material.

9. The apparatus as claimed in any one of claims 1 to 3 wherein said cutting means includes a frame, said knives being supported from said frame, and wherein said knives are movable relative to a stationary stack of sheets supported on said carrier means during the removal of the corners from the sheets.

10. The apparatus as claimed in any one of claims 1 to 3 wherein the location of said cutting means knives are fixed during a corner cutting operation and wherein said carrier means each comprises a two-piece movable support plate whereby the stacked sheet material may be fed into operative engagement with said knives, each piece of said support plate being separately movable toward and away from said knives.

11. The apparatus as claimed in any one of claims 1 to 3 wherein said cutting means knives have straight cutting edges and wherein said cutting means further comprises:

frame means;

means for rotatably suspending said knives form said frame means; and drive means for imparting reciprocating movement on curved paths across the corners of a stack of sheets to each of said knives, said suspending means and drive means cooperating to cause the knives to initiate cutting at the edges of the sheet material on the cutting line defined by the moving knives whereby the removal of the corners from the sheets begins at the edges thereof.

12. The apparatus of claim 11 wherein said drive means are controlled such that adjacent knives execute cutting movements in opposite directions.

13. The apparatus as claimed in any one of claims 1 to 3 wherein said cutting means knives are of generally circular shape and simultaneously engage the sheets of the stack.

14. The apparatus of claim 4 further comprising adjustable support means for said knives where the location of said cutting means knives can be varied in a pair of transverse directions to accommodate different sheet sizes.

15. The apparatus of claim 4 wherein the positions of at least some of said carrier means magazine defining guides can be adjusted whereby said carrier means may accommodate different size sheets of material.

16. The apparatus of claim 14 wherein the positions of at least some of said carrier means magazine defining guides can be adjusted whereby said carrier means may accommodate different size sheets of material.

17. The apparatus of claim 16 wherein said hold-down means comprises plural hold-down elements which respectively contact the uppermost sheet of a stack of sheets of material adjacent a cutting line defined by a said knife and exert a compressive force on the stack of sheets.

18. The apparatus of claim 16 wherein said hold-down means comprises a replaceable plate which is commensurate in size with the size of the sheet material being shaped.

19. The apparatus of claim 16 wherein said carrier means magazine defining guides are mounted from said support plate and wherein said support plate is provided with slots which receive said guides whereby the dimensions of the stack receiving magazine can be varied by repositioning said guides in said slots.

20. A method for shaping sheets of material which have been formed into a stack, the sheets initially having a generally rectangular shape and being withdrawn from the stack after shaping for further processing, said method comprising the steps of:

exerting a compressive force on the stack of sheets; and imparting reciprocating movement along curved paths which intersect the corners of the stack of sheets to a plurality of knives, each knife having a generally straight cutting edge and being associated with a single corner for the stacked sheets;

bringing the moving knives simultaneously into operational contact with the corners of the stack of held-down sheets to remove the corners therefrom, the knives executing a cutting action which begins a the edges of the sheets and extends along a cutting line towards the mid-point thereof.

21. The method of claim 20 further comprising:

positioning the stack of sheets to be shaped in a magazine on a carrier, the carrier having a planar stack support surface;

moving the carrier in a first direction to place it in registration with the knives; and imparting movement in a second direction to the stack of sheets to advance the stack of sheets toward the moving knives, said second direction being generally transverse to the planar support surface.

* * * * *

UNITED STATES PATENT AND TRADEMARK OFFICE

CERTIFICATE OF CORRECTION

PATENT NO. : 5,211,090
DATED : May 18, 1993
INVENTOR(S) : Horst Rathert

It is certified that error appears in the above-indentified patent and that said Letters Patent is hereby corrected as shown below:

Column 5, line 37, "form" should read --from--.

Column 5, line 39, "sand" should read --said--.

Column 6, line 7, "second" should read --said--.

Column 6, line 24, "lien" should read --line--.

Column 6, line 59, "form" should read --from--.

Column 7, line 9, "where" should read --wherein--.

Column 8, line 15, "for" should read --of--.

Column 8, line 20, "a" should read --at--.

Signed and Sealed this

Nineteenth Day of September, 1995

*Attest:*

*Attesting Officer*

Bruce Lehman

BRUCE LEHMAN

*Commissioner of Patents and Trademarks*